US008300859B2

(12) United States Patent
Han et al.

(10) Patent No.: US 8,300,859 B2
(45) Date of Patent: Oct. 30, 2012

(54) SPEAKER DEVICES AND METHODS OF MAKING THE SAME

(75) Inventors: Wei-Kuo Han, Hsinchu (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 803 days.

(21) Appl. No.: 12/427,750

(22) Filed: Apr. 22, 2009

(65) Prior Publication Data

US 2010/0067720 A1 Mar. 18, 2010

(30) Foreign Application Priority Data

Sep. 12, 2008 (TW) ..... 97135240 A

(51) Int. Cl.
*H04R 1/00* (2006.01)

(52) U.S. Cl. ..... 381/191

(58) Field of Classification Search ..... 381/191, 381/175, 396, 400, 170, 172; 181/157
See application file for complete search history.

(56) References Cited

U.S. PATENT DOCUMENTS

| | | | | |
|---|---|---|---|---|
| 6,199,655 | B1 | 3/2001 | Norris | |
| 6,594,369 | B1 * | 7/2003 | Une | 381/174 |
| 6,920,225 | B2 * | 7/2005 | Yonehara et al. | 381/174 |
| 7,386,136 | B2 * | 6/2008 | Ohbayashi et al. | 381/174 |
| 8,107,651 | B2 * | 1/2012 | Liou et al. | 381/191 |
| 2003/0068055 | A1 * | 4/2003 | Tanabe et al. | 381/191 |
| 2007/0165896 | A1 * | 7/2007 | Miles et al. | 381/356 |
| 2007/0195976 | A1 * | 8/2007 | Sekino et al. | 381/191 |
| 2007/0242844 | A1 * | 10/2007 | Harman | 381/191 |
| 2009/0067663 | A1 * | 3/2009 | Ivey et al. | 381/386 |
| 2009/0304212 | A1 * | 12/2009 | Han et al. | 381/191 |
| 2010/0024198 | A1 * | 2/2010 | Chen et al. | 29/594 |
| 2011/0255719 | A1 * | 10/2011 | Liou et al. | 381/191 |

FOREIGN PATENT DOCUMENTS

| | | |
|---|---|---|
| CN | 1612658 | 5/2005 |
| CN | 2713765 | 7/2005 |
| CN | 1997243 | 7/2007 |
| CN | 101043763 | 9/2007 |
| KR | 100751012 | 8/2007 |
| TW | M308201 | 3/2007 |
| TW | 200726300 | 7/2007 |
| TW | I299422 | 8/2008 |

OTHER PUBLICATIONS

"Office Action of Taiwan Counterpart Application of Co-pending Application" issued on Oct. 13, 2010, p. 1-p. 6.
"Office Action of Taiwan Counterpart Application", issued on May 30, 2012, p. 1-p. 12.
"Notice of Allowance of U.S. counterpart application, U.S. Appl. No. 12/370,599" issued on Feb. 27, 2012, p. 1-p. 7.
"First Office Action of China Counterpart Application", issued on Mar. 28, 2012, p. 1-p. 13.

* cited by examiner

*Primary Examiner* — Savitr Mulpuri
(74) *Attorney, Agent, or Firm* — Jianq Chyun IP Office

(57) ABSTRACT

A speaker device including a transparent speaker and a light source module is provided. The transparent speaker is thin, soft, and has a low driving voltage. Light is emitted from a front side of the speaker panel, and transmitted in the same direction as the sound. Thus, the light is emitted along with the sound. The speaker device can be used as an indoor wall-painting or as a large advertisement poster for more visual effects to the viewer.

55 Claims, 10 Drawing Sheets

SPEAKER DEVICES AND METHODS OF MAKING THE SAME

RELATED APPLICATIONS

The application claims the priority benefit of Taiwan patent application serial no. 97135240, filed Sep. 12, 2008. The application is related to two other co-pending patent applications on Feb. 13, 2009 respectively entitled "SPEAKER DEVICES" (application Ser. No. 12/370,598 and "METHODS OF MAKING SPEAKERS" (application Ser. No. 12/370,599). The entirety of each of the above-mentioned patent applications, including the claims, is hereby incorporated by reference herein and made a part of the specification.

BACKGROUND

1. Technical Field

Embodiments disclosed herein relate to speakers and methods of making speakers, and more specifically, to methods of making speakers that may be configured to be integrated into a roll-to-roll manufacturing process.

2. Description of Related Art

Visual and acoustic means are two effective ways of communication. As a result, scientists and engineers have continued to develop components and systems for visual or acoustic applications. One acoustic application may include the use of speakers, including electro-acoustic speakers. Electro-acoustic speakers may be categorized as direct and indirect radiant speakers. Generally, speakers can also be roughly categorized, based on their operating theories, into dynamic speakers, piezoelectric speakers and electrostatic speakers. Dynamic or magnetic-membrane speakers have been frequently used because of their well-developed technologies and have dominated the speaker market. However, dynamic or magnetic-membrane speakers may have disadvantages due to their large sizes, making them less desirable for portable or smaller-sized consumer products or for other applications that have space constraints.

In contrast, piezoelectric speakers operate based on the piezoelectric effects of piezoelectric materials and rely on the application of electrical fields to piezoelectric materials to drive sound-producing diaphragms or membranes. Piezoelectric speakers generally require less space and may have thin or planar designs. However, piezoelectric materials formed by sintering processes may be rigid and inflexible.

Additionally, electrostatic speakers are generally designed with two fixed electrode-plates having holes and a conductive membrane between the two plates for forming a capacitor. A DC voltage bias may be applied to the membrane, and an AC voltage may be applied to the two electrodes. The electrostatic force generated by the positive and negative fields may drive the conductive membrane to generate sound.

Moreover, efforts have been made to combine visual and acoustic applications. For example, a holographic transparent speaker as disclosed in U.S. Pat. No. 6,199,655 is an electrostatic speaker with the diaphragm made of Mylar or Kapton. This speaker is characterized in that the holes opened in the bi-layer transparent electrode plate are arranged in an interlaced manner, so as to generate a holographic visual effect. However, the above speaker may not produce an image effect, nor achieve a lighting effect in a dark environment for lack of an active light source module.

BRIEF SUMMARY OF INVENTION

Consistent with the disclosed embodiment, there is provided a speaker device, including a speaker panel module including a diaphragm including an electret material having a conductive film formed on a surface of the diaphragm, and a fixed electrode plate having a plurality of openings and a plurality of spacers, the plurality of spacers are placed between the fixed electrode plate and the diaphragm for providing an operation area for the diaphragm to move and generate sound, and a light source module for providing light projected through at least a portion of the speaker panel module. Consistent with the disclosed embodiments, there is also provided a speaker device, including a speaker panel module, comprising a diaphragm comprising an electret material and a conductive film is formed on a surface of the diaphragm, a fixed electrode plate having a plurality of openings and a plurality of spacers, wherein the plurality of spacers are between the fixed electrode plate and the diaphragm for providing an operation area for the diaphragm, and a planar light source module configured to provide light projected from at least a portion of the speaker panel module.

Consistent with the disclosed embodiments, there is further provided a speaker device with a transparent speaker panel module, wherein the transparent speaker panel module comprises a diaphragm, made of an electret material, wherein a conductive film is formed on a surface of the diaphragm, and a fixed electrode plate, comprising a plurality of openings and a plurality of spacers, wherein the spacers are placed between the fixed electrode plate and the diaphragm so as to provide an operation area for the diaphragm to move and generate a sound, wherein light from outside the transparent speaker panel is incident through the transparent speaker panel on the transparent speaker panel module, so as to enable the transparent speaker panel module to make a sound and emit light in the same direction.

BRIEF DESCRIPTION OF THE DRAWINGS

The accompanying drawings are included to provide a further understanding of the embodiments disclosed herein, and are incorporated in and constitute a part of this specification. The drawings illustrate embodiments disclosed herein and, together with the description, serve to explain the principles of the disclosed embodiments.

DETAILED DESCRIPTION OF THE DISCLOSED EMBODIMENTS

Consistent with the disclosed embodiments, the proposed methods may offer flexibilities in making speakers having large membrane areas, irregular shapes, or other customizable characteristics.

Examples of speaker devices are described with the embodiments described below. Additional descriptions of variations in speaker designs may be found in two other co-pending patent applications submitted by the same applicants and respectively entitled "SPEAKER DEVICES" (application Ser. No. 12/370,598) and "METHODS OF MAKING SPEAKERS" (application Ser. No. 12/370,599), which are hereby incorporated by reference herein and made a part of the specification.

Figure 1:
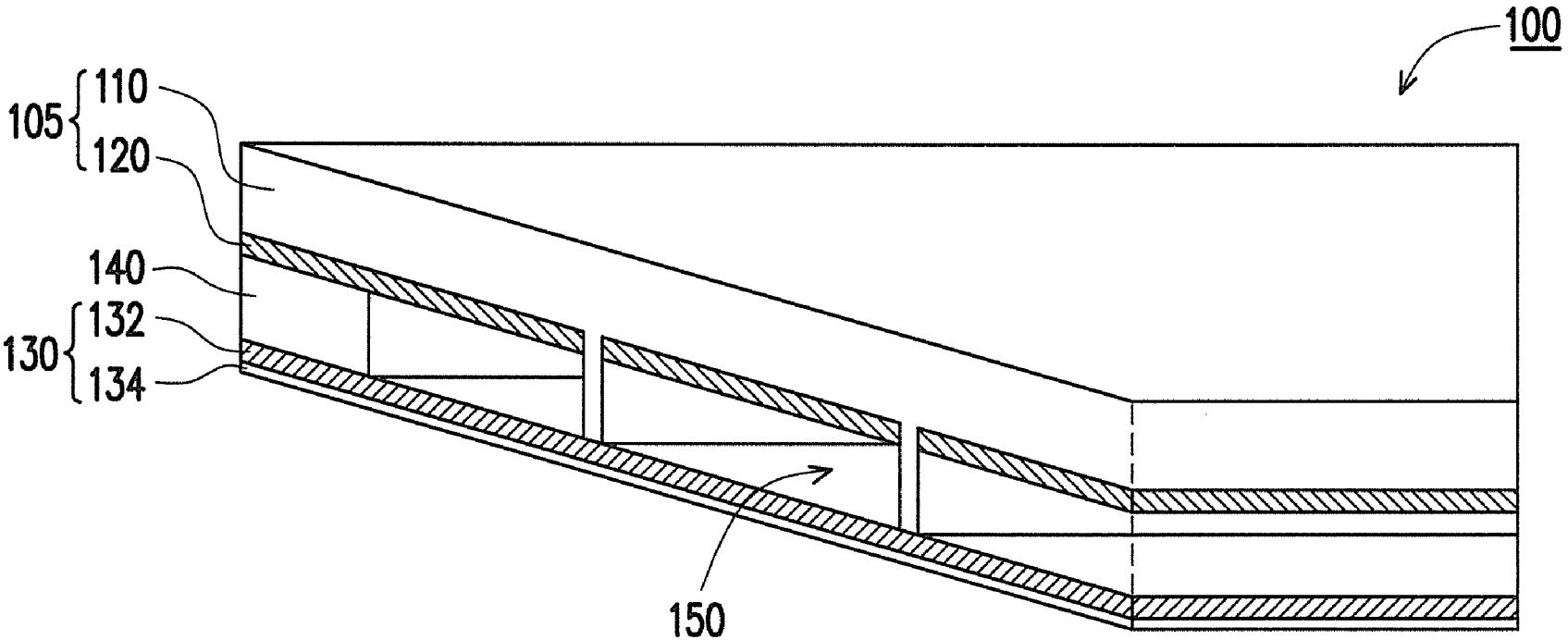
FIG. 1 is a schematic of a three-dimensional cross-section of part of a transparent speaker panel combination modules.

FIG. 1 is a partial cross-section of a transparent speaker panel combination module consistent with the disclosed embodiments. The speaker panel combination module 100 includes a transmissive fixed electrode plate 105 fixed opposite a diaphragm 130, on a transparent frame 140.

Fixed electrode plate 105 includes a film layer 110 and an electrode film 120 formed on a surface of film layer 110, and may have a plurality of sound holes. Diaphragm 130 is made of an electret material 132 with a conductive film 134 on a surface of electret material 132. Electret film 132 may be formed on diaphragm by an electroplating or sputtering process. Transparent frame 140 is located between fixed electrode plate 105 and diaphragm 130. Electrode film 120 is formed on a surface of film layer 110 such that electrode film is facing diaphragm 130, and conductive film 134 is formed on a surface of diaphragm 130 opposite to the surface facing electrode film 120.

In an embodiment, a plurality of spacers may be directly formed below the fixed electrode plate 105, such that diaphragm 130 rests on the spacers forming spaces for the vibration of diaphragm, and thereby maintaining a fixed gap between fixed electrode plate 105 and diaphragm 130. The spacers may be solid protruding spacers or hollow protruding spacers and may be formed by stamping fixed electrode plate 105. Further, transparent frame 140 may be placed on the end edge of combination structure 100, so as to form a transparent electroacoustic composite panel.

Speaker panel combination module 100 may be a flexible structure. That is, fixed electrode plate 105, diaphragm 130, and transparent frame 140 may be made of flexible materials such as a transparent polymer material, including materials such as polycarbonate (PC), polyethylene terephthalate (PET), cyclic olefin copolymer (COC), or polymethyl methacrylate (PMMA). In some embodiments electrode film 120 or conductive film 134 may also be made of a transparent material, such as indium tin oxide (ITO) or indium zinc oxide (IZO). Moreover, in some embodiments, a metal reflective film of aluminum or silver may be adopted to provide a reflective material.

Consistent with the disclosed embodiments, film layer 110 may be made of a conductive or a non-conductive material. When film layer 110 is made of a non-conductive material such as plastics (PET or PC), rubber, paper, or non-conductive cloth (cotton fibre or polymer fibre), electrode film 120 may be made of a pure metal material like aluminum, gold, silver, or copper, an alloy thereof, or a bi-metal material like Ni/Au, or indium tin oxide (ITO) or indium zinc oxide (IZO) or a combination thereof, or a polymer conductive material like PEDOT. Moreover, electrode film 120 may further be made of a reflective material such as a metal reflective film of aluminum or silver to enhance the luminance output by structure 100.

When film layer 110 is made of a conductive material, which may include, for example, a metal (iron, copper, aluminum, or an alloy thereof) or a conductive cloth (metal fibre, metal oxide fibre, carbon fibre, or graphite fibre), electrode film 120 is unnecessary and not formed on fixed electrode plate.

Figure 2A:
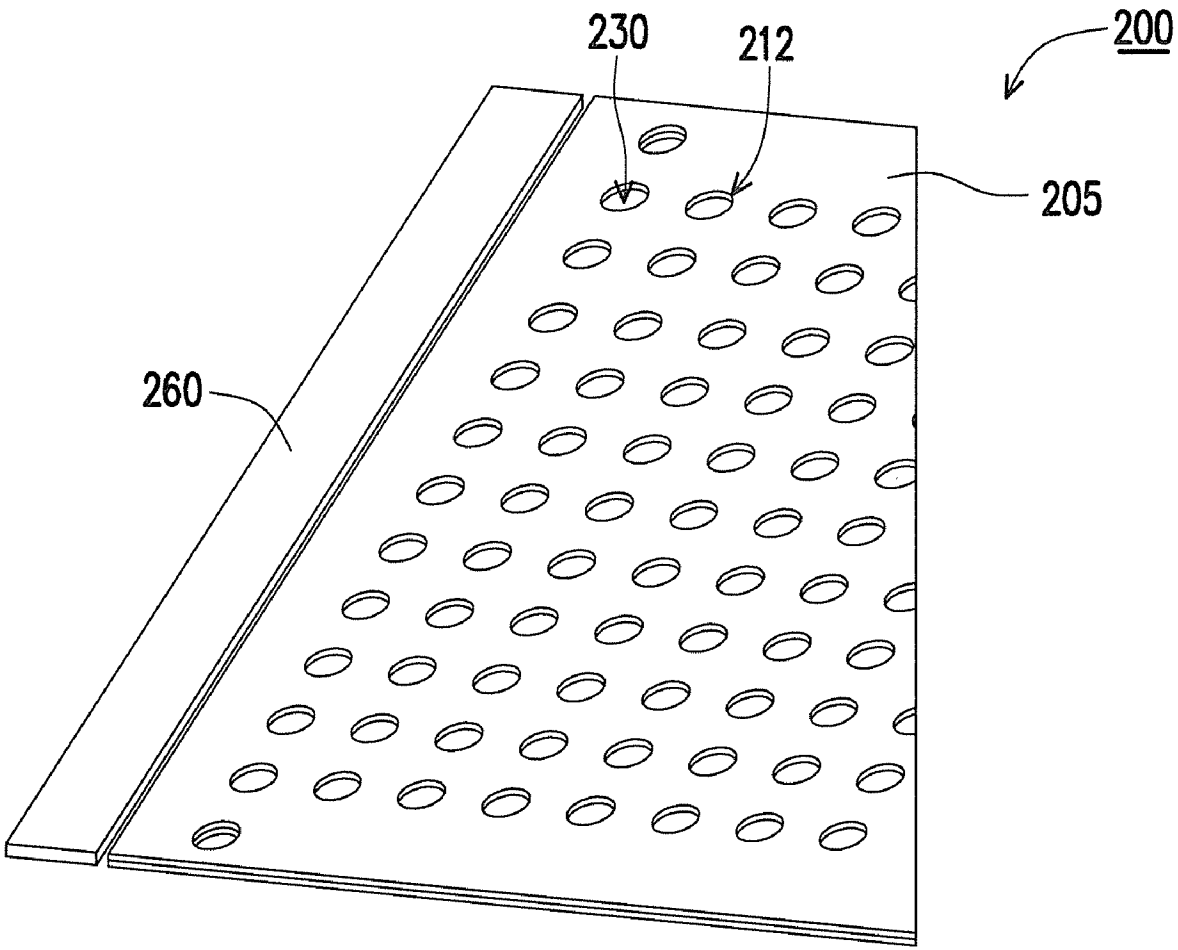
FIG. 2A is a partial three-dimensional view of a speaker panel combination module with a strip light source module located at an end edge thereof.
Figure 2B:
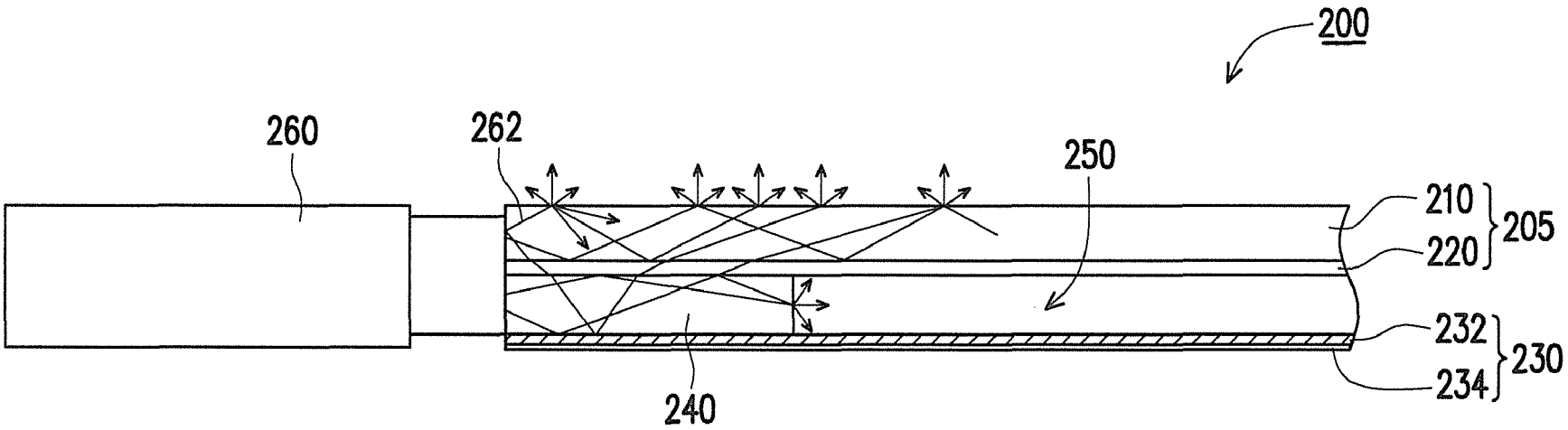
FIG. 2B is a cross-section showing that light is incident from an end edge and emitted to the center of the speaker panel combination module through an optical waveguide.

FIG. 2A is a partial cross-section of a speaker panel combination module according to an embodiment of the present invention. FIG. 2B illustrates that a light is incident from an end edge and emitted to the center of the speaker panel combination module through an optical waveguide. The speaker panel combination module 200 includes a transmissive fixed electrode plate 205 and a diaphragm 230. A transparent frame 240 is placed on the periphery of speaker panel combination module 200, and is located between fixed electrode plate 205 and diaphragm 230. A plurality of sound holes 212 are formed in fixed electrode plate 205, for enabling air in the gap between fixed electrode plate 205 and diaphragm 230 to pass through sound holes 212 into the ambient environment, such that when diaphragm 230 vibrates, air in the gap between fixed electrode plate 205 and diaphragm is pushed through sound holes 212 to make a sound.

Fixed electrode plate 205 includes a film layer 210 and an electrode film 220 formed on a surface of film layer 210. Consistent with the disclosed embodiments, diaphragm 230 may include an electret material 232 and a conductive film 234 formed on a surface of electret material 232. Frame 240 is provided such that a vibration space may be formed between fixed electrode plate 205 and diaphragm 230. Electrode film 220 is formed on a surface of diaphragm 230 facing the vibration space, and conductive film 234 is formed on an opposite surface of the diaphragm 230.

Consistent with a disclosed embodiment, a transparent electroacoustic composite panel is provided in speaker panel combination module 200. Light emitted from a strip light source module 260 is incident from an end edge of transparent speaker panel combination module 200 along a light path marked by 262, such that speaker panel combination module 200 is emits light as sound is emitted, when provided in a nighttime or darkened environment. Consistent with a disclosed embodiment, light source module 260 may be formed by a light-emitting diode (LED), a laser, a cold cathode fluorescent lamp (CCFL), or an organic light-emitting diode (OLED).As shown in 2B, light is transmitted into speaker panel combination module along light path 262 and is diffused around by refraction or reflection based on material properties of speaker panel combination module 200 and the shape, size, and spacing of sound holes 212. A part of the light will be emitted from transmissive electrode plate 205 when the incident angle of the light is smaller than the total reflection angle from transmissive electrode plate 205 to the air, thus achieving a function similar to a backlight plate, so as to form a light-emitting effect of speaker panel combination module 200. Consistent with the disclosed embodiments, light source module structure 260 may be integrally formed with speaker panel combination module 200, providing a convenient one-piece light and sound emitting device which may be convenient to carry while remaining flexible.

Consistent with other embodiments, light source module 260 may be modified in order to improve the light-emitting effect of speaker panel combination module 200. For example, a backlight plate, may be laminated on transmissive fixed electrode plate 205. In addition, reflective spots or reflective convex-concave micro-structures may be printed on the bottom surface of the backlight plate to enhance the reflection efficiency.

Figure 3A:
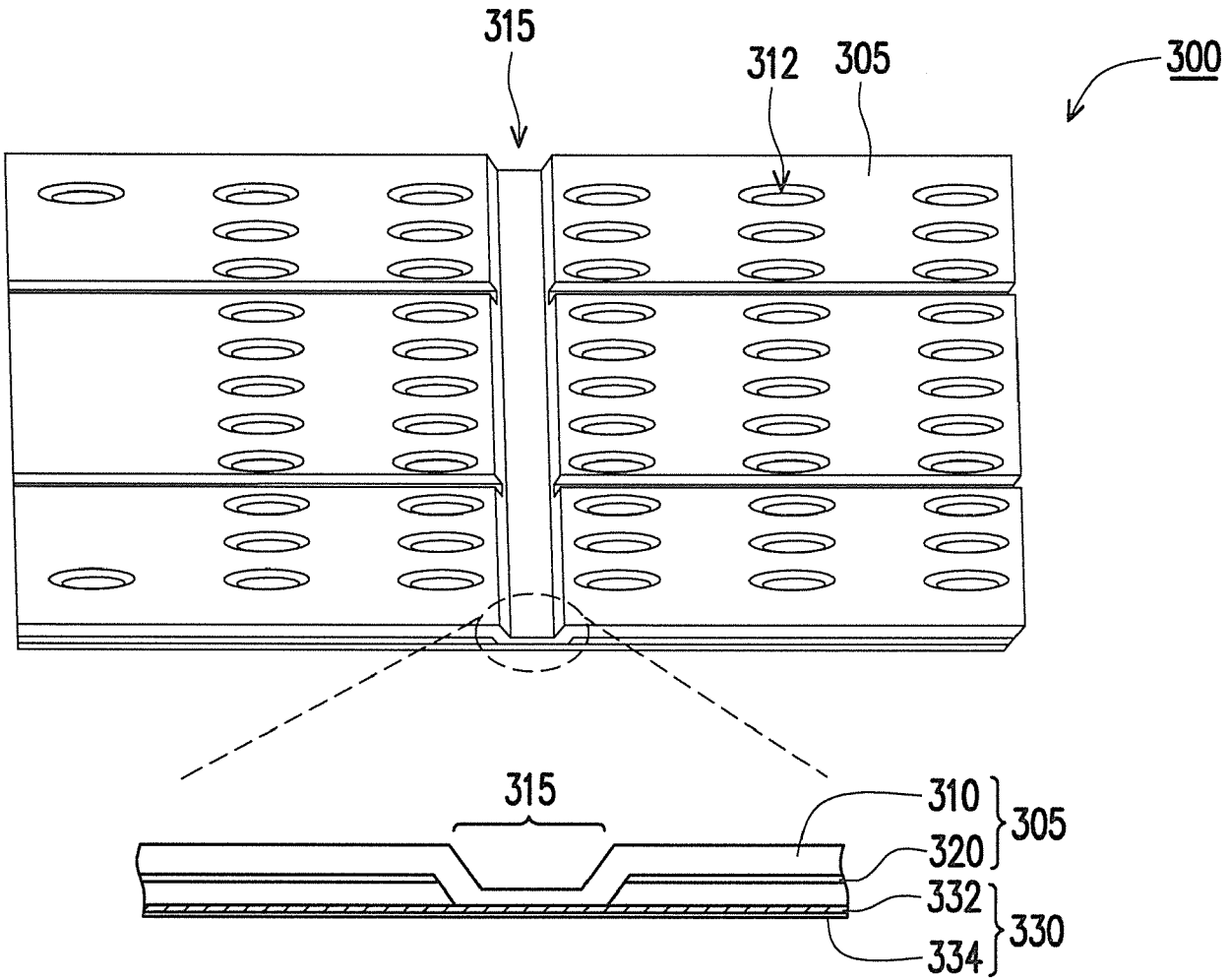
FIG. 3A is a partial cross-section of a speaker panel combination module having a fixed electrode plate with spacers, in which the spacers are used to maintain a fixed gap between the fixed electrode plate and the diaphragm, thus sustaining the space of the operation area in the speaker.
Figure 3B:
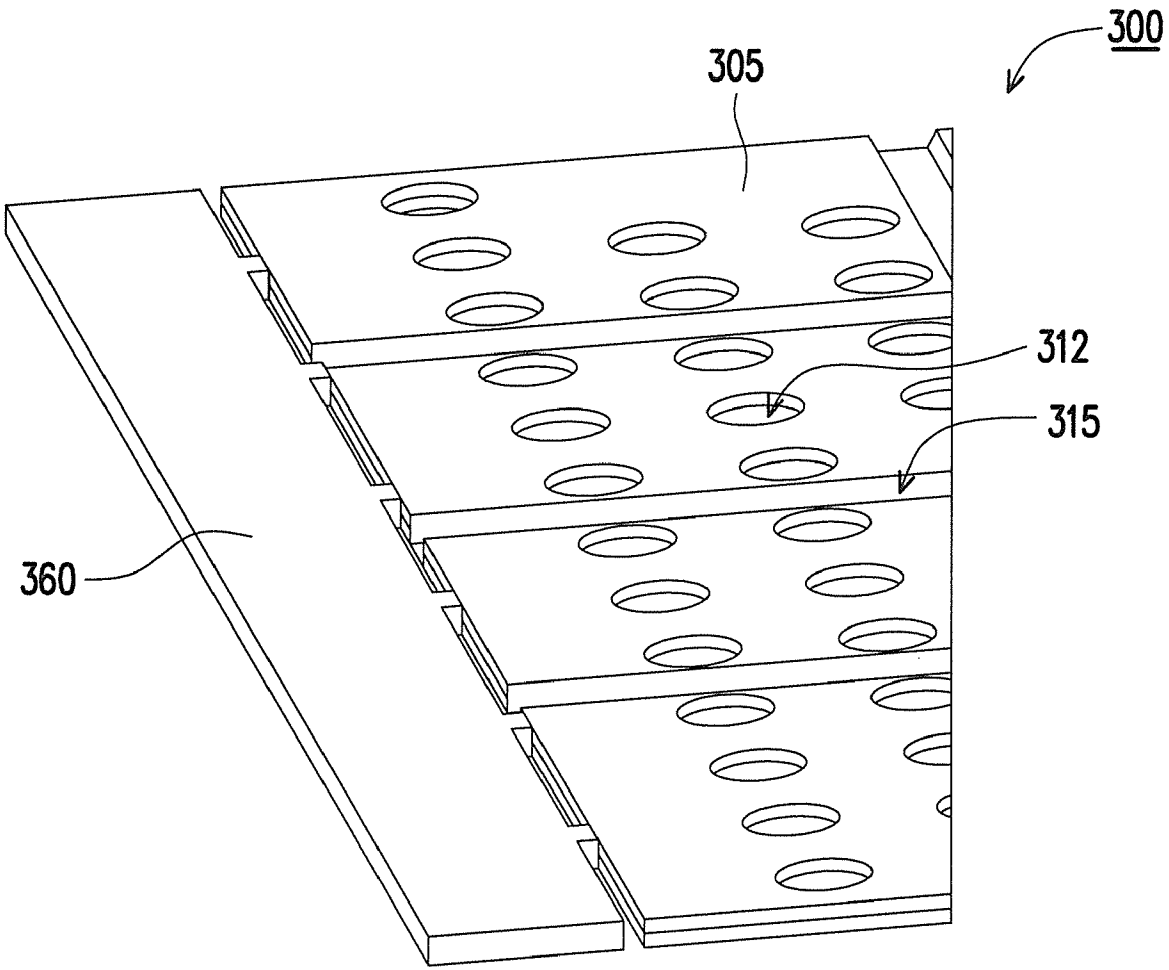
FIG. 3B is a partial three-dimensional view of a speaker panel combination module and a light source module combination in the structure of FIG. 3A.

FIGS. 3A and 3B are side views of a speaker panel combination module according to another embodiment. Speaker panel combination module 300 includes a transmissive fixed electrode plate 305, a diaphragm 330, and a strip light source module 360 located at four end edges of speaker panel combination module.

Fixed electrode plate 305 includes a film layer 310 and an electrode film 320 formed on a surface of film layer 310. Fixed electrode plate 305 may be formed to include a plurality of sound holes 312. Diaphragm 330 includes an electret material 332 having a conductive film 334 formed on a surface of electret material 332. Speaker panel combination module 300 includes spacers 315 formed in fixed electrode plate 305, so as to form a vibration space for making sound. As shown in FIG. 3A, spacers 315 are formed to have bar shape with a U-shaped side surface. Consistent with the disclosed embodiments, spacer 315 may be formed to have a round shape, a shape of a polygon or a cross, and may be adjustable according to design requirements. Further, a transparent frame may be placed on an end edge of the speaker panel combination module 300, so as to form a transparent electroacoustic composite panel with spacers.

Figure 4:
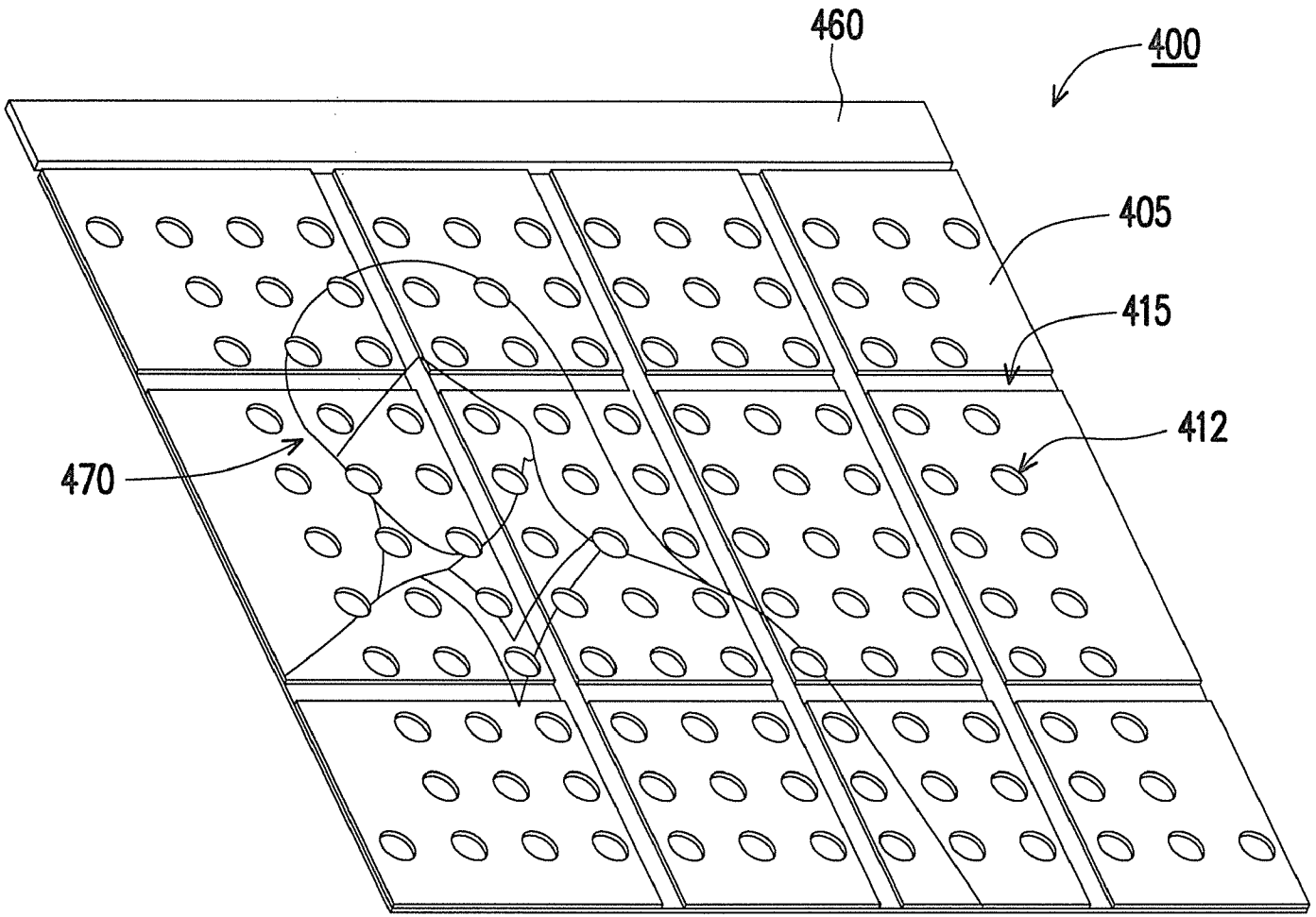
FIG. 4 is a three-dimensional view of a speaker panel combination module having an opaque or semi-transparent pattern, a fluorescent pattern, an obscure glass pattern, or an engraved pattern.

FIG. 4 is a side view of a speaker panel combination module according to another embodiment. The speaker panel combination module 400 includes a transmissive fixed electrode plate 405, sound holes 412, and bar-shaped perpendicularly crossed spacers 415. The structure of speaker panel combination module 400 may be similar to speaker panel combination modules 100, 200, and 300, respectively shown in FIGS. 1A and 1B, FIGS. 2A and 2B, and FIGS. 3A and 3B. In speaker panel combination module 400, a pattern 470 is printed on transparent fixed electrode plate 405. Pattern 470 may be an opaque or semi-transparent pattern, a fluorescent pattern, an obscure glass pattern with diffusion effect, or an engraved pattern. By printing pattern 470 on electrode plate 405, light emitted from light source module 460 illuminates or passes through pattern 470 creating a visual image viewable by an observer, and thus the speaker device can be used as an indoor wall-painting for more visual effects. In another embodiment, pattern 470 may also be attached to, or mounted on, the transparent fixed electrode plate 405 instead of being printed thereon.

Figure 5A:
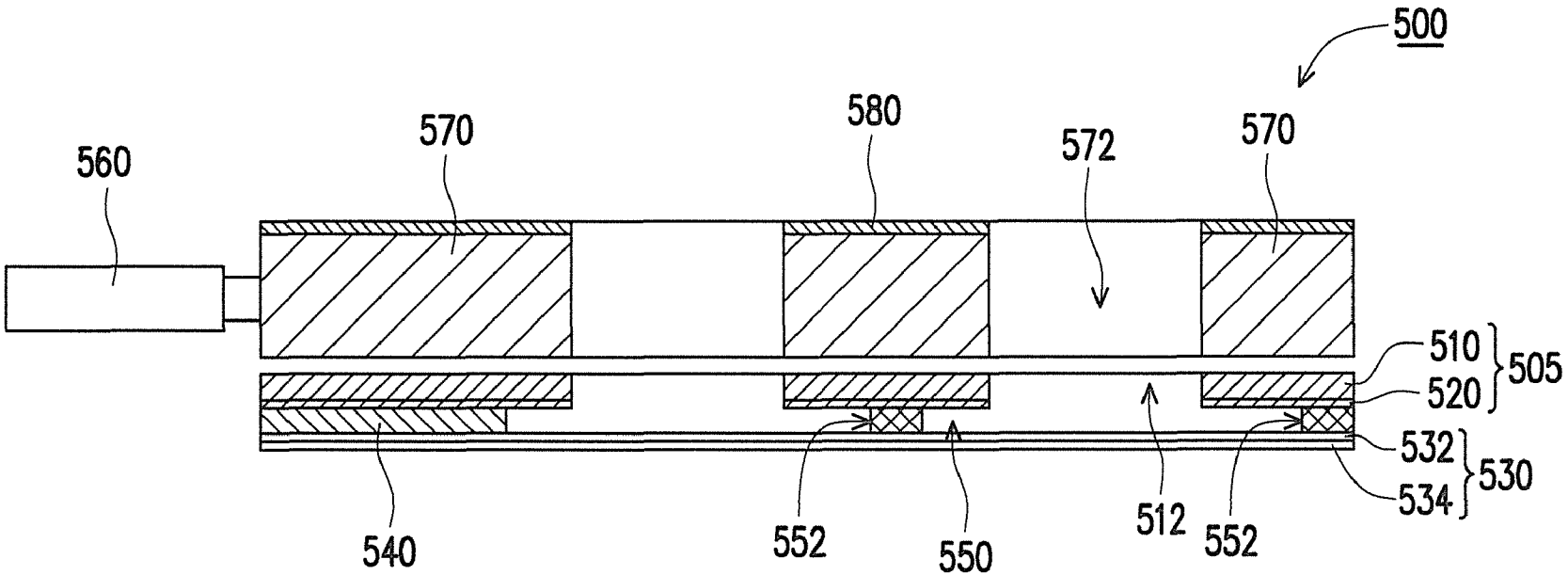
FIG. 5A is a partial cross-sectional view of a speaker panel combination module with a light plate structure, in which the light plate structure having sound holes is placed in front of the fixed electrode plate.

FIG. 5A is a partial cross-section of a speaker panel combination module according to another embodiment. Speaker panel combination module 500 includes a fixed electrode plate 505, a diaphragm 530, and a frame 540 placed between fixed electrode plate 505 and diaphragm 530. A plurality of sound holes 512 may be formed in fixed electrode plate 505, for enabling the air in the gap between the fixed electrode plate 505 and the diaphragm 530 to pass through sound holes 512 into the ambient environment, such that the vibration of diaphragm 530 pushes the air through the sound holes 512 to make a sound.

Fixed electrode plate 505 includes a film layer 510 and an electrode film 520 formed on a surface of film layer 510. Diaphragm 530 includes an electret material 532 and a conductive film 534 formed on a surface of electret material 532. Electrode film 520 is formed on a side of film layer facing diaphragm 530, and conductive film 534 is formed on a surface of diaphragm 530 opposite to the surface facing the electrode plate 505.

A vibration space 550 is formed between fixed electrode plate 505, diaphragm 530, and adjacent spacers 552. Spacers 552 are adhered to fixed electrode plate 505, or formed by stamping fixed electrode plate 505, and have a structure that may be adjusted in height and width according to particular design requirement.

Consistent with the disclosed embodiments, a light plate structure 570 may be placed above speaker panel combination module 500. Sound holes 572 corresponding to sound holes 512 of the fixed electrode plate 505 are formed in light plate structure 570, so as to facilitate air flowing through the sound holes 512 and 572. Light is generated by light source module 560, and is directly incident on a side surface of light plate structure 570, and then emitted to the center of light plate structure 570 through an optical waveguide. During light transmission, the light is diffused by refraction or reflection based on the material properties of light plate structure 570 and the shape of sound holes 572, which produces a light emission through a front side of speaker panel combination module 500.

Reflective spots or reflective convex-concave micro-structures may be printed on a bottom surface of light plate structure 570 to enhance the reflection characteristics. Further, a reflective layer may be coated on a surface where fixed electrode plate 505 is coupled to light plate structure 570, so as to further improve the reflection characteristics. In this embodiment, the materials of film layer 510 and electrode film 520 of fixed electrode plate 505, electret material 532 of diaphragm 530 and conductive film 534 on the surface thereof, and frame 540 are not limited to light- transmissive materials, and various opaque materials may instead be used.

A pattern 580 may be printed on light plate structure 570. Pattern 580 may be an opaque or semi-transparent pattern, a fluorescent pattern, an obscure glass pattern with diffusion effect, or an engraved pattern. Light illuminating of passing through pattern 580 creates a visual image which is viewable by an observer. Consistent with the disclosed embodiments, pattern 580 may be removable and replaceable such that a user can interchange patterns 580, allowing the user to have many different viewable images from which to choose. Consistent with other embodiments, a phosphor powder may be added to pattern 580 or to light plate structure 570, such that the energy provided by light emitted from light source module 560 remains in the phosphor powder even after light source module 560 is turned off so that pattern 580 or light plate structure glows in the dark, thus prolonging the light-emitting effect.

Figure 5B:
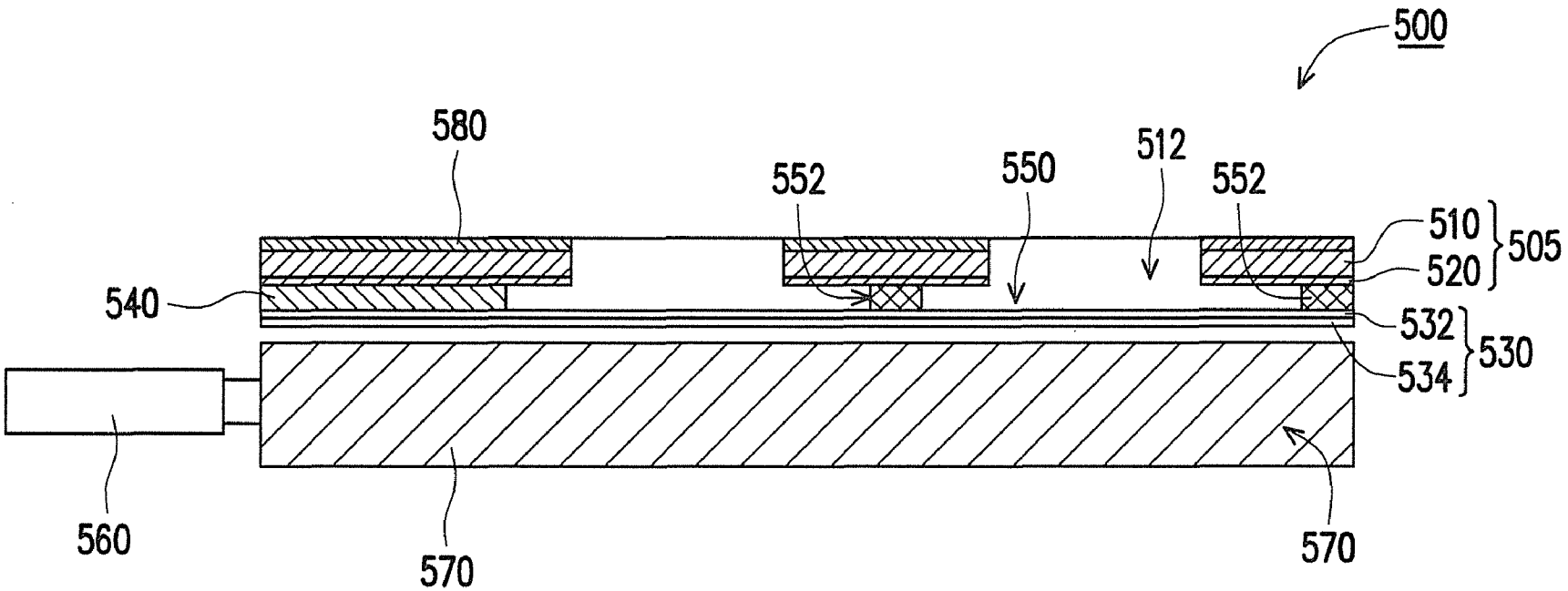
FIG. 5B is a partial cross-section of a speaker panel combination module with a light plate structure, in which the light plate structure is placed behind the fixed electrode plate.

FIG. 5B is a partial cross-section of a speaker panel combination module according to another embodiment. This structure is similar to that in FIG. 5A, so the details will not be described herein again. Different from the structure in FIG. 5A, light plate structure 570 in this embodiment is placed behind diaphragm 530, and thus there is no need to form sound holes 572 as shown in FIG. 5A.

Light is generated by light source module 560, and is directly incident on a side surface of light plate structure 570, and then emitted to the center of light plate structure 570 through an optical waveguide. During light transmission, the light is diffused by refraction or reflection based on the material properties of light plate structure 570, which produces a light emission through a front side of speaker panel combination module 500. Further, reflective spots or reflective convex-concave micro-structures may be printed on the bottom surface of light plate structure 570 to enhance the reflection characteristics of light plate structure 570.

Similar to FIG. 5A, a pattern 580 may be printed on light plate structure 570. Pattern 580 may be an opaque or semi-transparent pattern, a fluorescent pattern, an obscure glass pattern with diffusion effect, or an engraved pattern. Light illuminating of passing through pattern 580 creates a visual image which is viewable by an observer. Consistent with the disclosed embodiments, pattern 580 may be removable and replaceable such that a user can interchange patterns 580, allowing the user to have many different viewable images from which to choose. Consistent with other embodiments, a phosphor powder may be added to pattern 580 or to light plate structure 570, such that the energy provided by light emitted from light source module 560 remains in the phosphor powder even after light source module 560 is turned off so that speaker panel combination module 500 glows in the dark.

Figure 6:
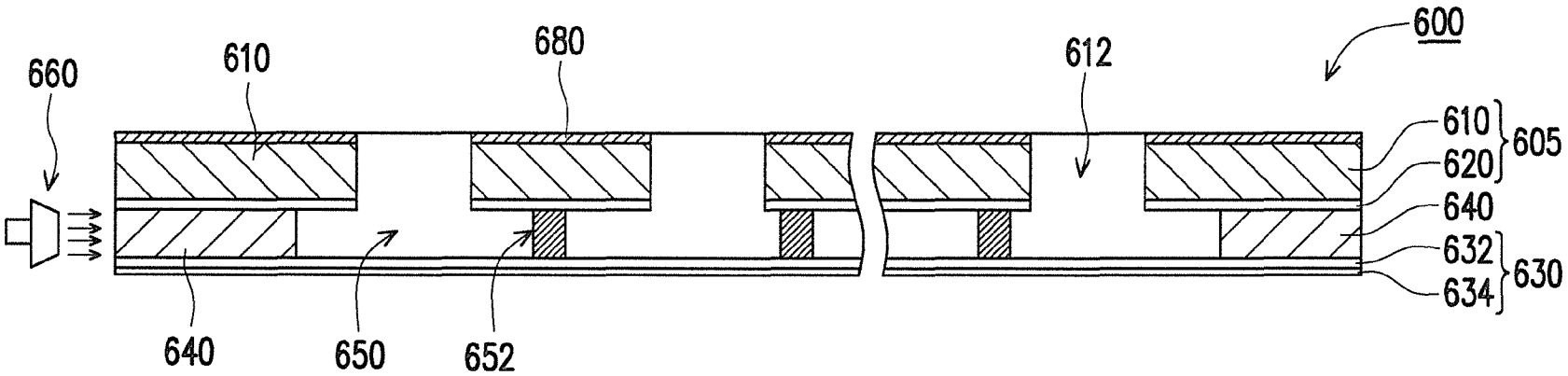
FIG. 6 is a partial cross-section of a speaker panel combination module with a light source module placed at an end edge of a frame, in which light generated by the light source module is directly incident from an end surface of the frame to a place between a transparent fixed electrode plate and a diaphragm.

FIG. 6 is a partial cross-section of a speaker panel combination module according to another embodiment. Speaker panel combination module 600 includes a fixed electrode plate 605, a diaphragm 630, and a frame 640 placed between fixed electrode plate 605 and diaphragm 630. A plurality of sound holes 612 may be formed in fixed electrode plate 605, for enabling the air in the gap between the fixed electrode plate 605 and the diaphragm 630 to pass through sound holes 612 into the ambient environment, such that the vibration of diaphragm 630 pushes the air through the sound holes 612 to make a sound. Fixed electrode plate 605 includes a film layer 610 and an electrode film 620 formed on a surface of film layer 610. Diaphragm 630 includes an electret material 632 and a conductive film 634 formed on a surface of electret material 632. Electrode film 620 is formed on a side of film layer facing diaphragm 630, and conductive film 634 is formed on a surface of diaphragm 630 opposite to the surface facing the electrode plate 605.

A vibration space 650 is formed between fixed electrode plate 605, diaphragm 630, and adjacent spacers 652. Spacers 652 are adhered to fixed electrode plate 605, or formed by stamping fixed electrode plate 605, and have a structure that may be adjusted in height and width according to particular design requirement.

Consistent with the disclosed embodiments, light is generated by light source module 660, and is directly incident on a side surface of frame 640, and then transmitted to a space between the transparent fixed electrode plate 605 and the diaphragm 630. Consistent with the illustrated embodiment, transparent fixed electrode plate 605, electrode 620, and frame 640 may be made of transmissive materials. Moreover, a reflective layer may be coated on the surface of diaphragm 630 to further improve its reflection characteristics. Electrode film 632 may also be made of a reflective material to further improve reflection characteristics.

A pattern 680 may be printed on electrode plate 605. Pattern 680 may be an opaque or semi-transparent pattern, a fluorescent pattern, an obscure glass pattern with diffusion effect, or an engraved pattern. Light illuminating or passing through pattern 680 creates a visual image which is viewable by an observer. Consistent with the disclosed embodiments, pattern 680 may be removable and replaceable such that a user can interchange patterns 680, allowing the user to have many different viewable images from which to choose. Consistent with other embodiments, a phosphor powder may be added to pattern 680 or to electrode plate 605, such that the energy provided by light emitted from light source module 660 remains in the phosphor powder even after light source module 660 is turned off so that speaker panel combination module 600 glows in the dark.

In another embodiment, light source module 660 may be omitted. Instead, speaker panel combination module 600 may be made of a transmissive material. That is, film layer 610 and electrode film 620 of transparent fixed electrode plate 605, diaphragm 630, and frame 640 are all made of transmissive or transparent materials, such that light from the ambient environment directly passes through speaker panel combination module 600 to display pattern 680.

Figure 7:
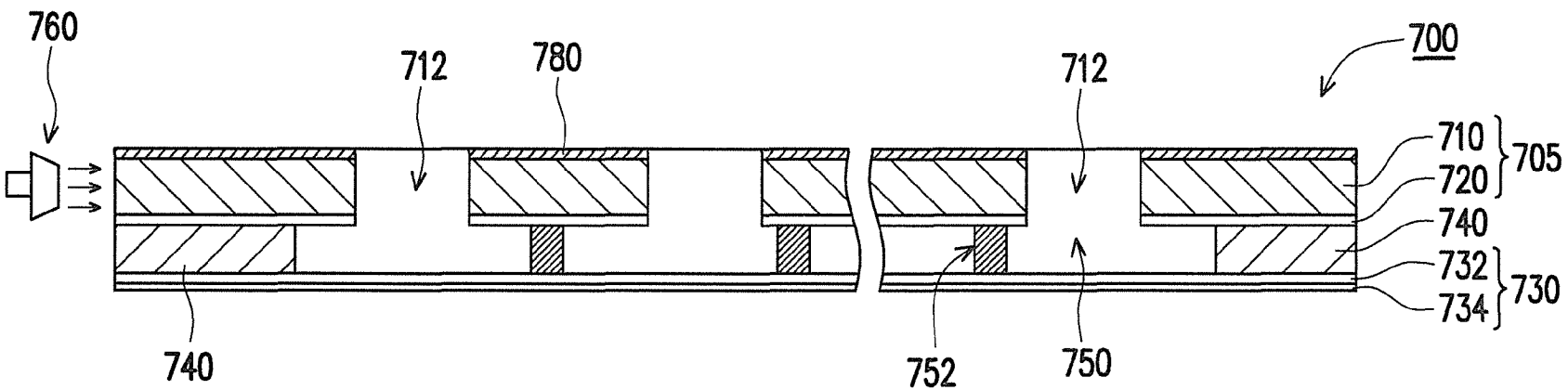
FIG. 7 is a partial cross-section of a speaker panel combination module with a light source module placed at an end edge of a fixed electrode plate, in which light generated by the light source module is directly incident from an end surface of the fixed electrode plate.

FIG. 7 is a partial cross-section of a speaker panel combination module according to another embodiment. Speaker panel combination module 700 includes a fixed electrode plate 705, a diaphragm 730, and a frame 740 placed between fixed electrode plate 705 and diaphragm 730. A plurality of sound holes 712 may be formed in fixed electrode plate 705, for enabling the air in the gap between the fixed electrode plate 705 and the diaphragm 730 to pass through sound holes 712 into the ambient environment, such that the vibration of diaphragm 730 pushes the air through the sound holes 712 to make a sound. Fixed electrode plate 705 includes a film layer 710 and an electrode film 720 formed on a surface of film layer 710. Diaphragm 730 includes an electret material 732 and a conductive film 734 formed on a surface of electret material 732. Electrode film 720 is formed on a side of film layer facing diaphragm 730, and conductive film 734 is formed on a surface of diaphragm 730 opposite to the surface facing the electrode plate 705.

A vibration space 750 is formed between fixed electrode plate 705, diaphragm 730, and adjacent spacers 752. Spacers 752 are adhered to fixed electrode plate 705, or formed by stamping fixed electrode plate 705, and have a structure that may be adjusted in height and width according to particular design requirement.

A pattern 780 may be printed on electrode plate 705. Pattern 780 may be an opaque or semi-transparent pattern, a fluorescent pattern, an obscure glass pattern with diffusion effect, or an engraved pattern. Light illuminating or passing through pattern 780 creates a visual image which is viewable by an observer. Consistent with the disclosed embodiments, pattern 780 may be removable and replaceable such that a user can interchange patterns 780, allowing the user to have many different viewable images from which to choose. Consistent with other embodiments, a phosphor powder may be added to pattern 780 or to electrode plate 705, such that the energy provided by light emitted from light source module 760 remains in the phosphor powder even after light source module 760 is turned off so that speaker panel combination module 700 glows in the dark.

Light generated by light source module 760 is directly incident on a side surface of the transparent fixed electrode plate 705. A reflective layer may be coated on the surface of electrode 720, so as to further improve the reflection characteristics of electrode 720. In other embodiments, the surface of diaphragm 730 or conductive film 734 may be made of a reflective material to also improve reflection characteristics.

Figure 8:
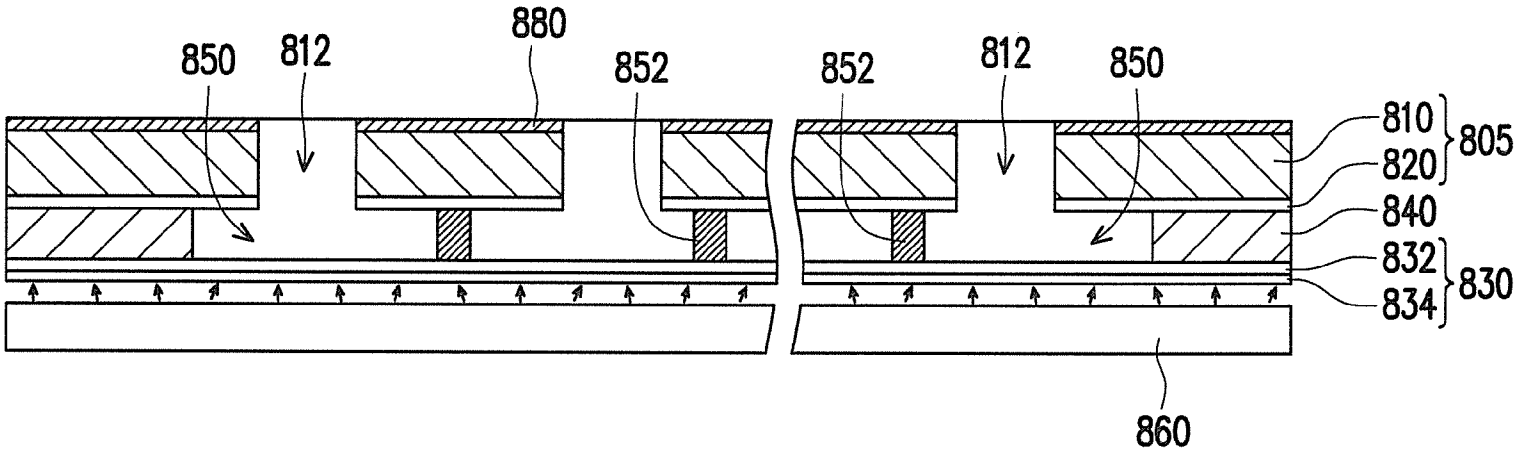
FIG. 8 is a partial cross-section of a speaker panel combination module with a planar light source module arranged in a direct-type manner.

FIG. 8 is a partial cross-section of a speaker panel combination module according to another embodiment. In this embodiment, a light source module is placed behind a transparent speaker panel so as to distribute light directly through the speaker panel combination module.

Speaker panel combination module 800 includes a fixed electrode plate 805, a diaphragm 830, and a frame 840 placed between fixed electrode plate 805 and diaphragm 830. A plurality of sound holes 812 may be formed in fixed electrode plate 805, for enabling the air in the gap between the fixed electrode plate 805 and the diaphragm 830 to pass through sound holes 812 into the ambient environment, such that the vibration of diaphragm 830 pushes the air through the sound holes 812 to make a sound. Fixed electrode plate 805 includes a film layer 810 and an electrode film 820 formed on a surface of film layer 810. Diaphragm 830 includes an electret material 832 and a conductive film 834 formed on a surface of electret material 832. Electrode film 820 is formed on a side of film layer facing diaphragm 830, and conductive film 834 is formed on a surface of diaphragm 830 opposite to the surface facing the electrode plate 805.

A vibration space 850 is formed between fixed electrode plate 805, diaphragm 830, and adjacent spacers 852. Spacers 852 are adhered to fixed electrode plate 805, or formed by stamping fixed electrode plate 805, and have a structure that may be adjusted in height and width according to particular design requirement.

Consistent with the illustrated embodiment, a light source module 860 having a plurality of light emitting units may be provided directly behind speaker panel combination module 800, such that light emitted from light source module 860 is through speaker panel combination module 800. In this embodiment, fixed electrode plate 805, diaphragm 830, and frame 840 are all made of a light-transmissive material to allow light emitted from light source module to be transmitted through speaker panel combination module 800. Individual light emitting units of light source module may be uniformly and evenly spaced throughout light source module, or may be configured according to design requirements.

A pattern 880 may be printed on electrode plate 805. Pattern 880 may be an opaque or semi-transparent pattern, a fluorescent pattern, an obscure glass pattern with diffusion effect, or an engraved pattern. Light illuminating or passing through pattern 880 creates a visual image which is viewable by an observer. Consistent with the disclosed embodiments, pattern 880 may be removable and replaceable such that a user can interchange patterns 880, allowing the user to have many different viewable images from which to choose. Consistent with other embodiments, a phosphor powder may be added to pattern 880 or to electrode plate 805, such that the energy provided by light emitted from light source module 860 remains in the phosphor powder even after light source module 860 is turned off so that speaker panel combination module 800 glows in the dark.

Figure 9:
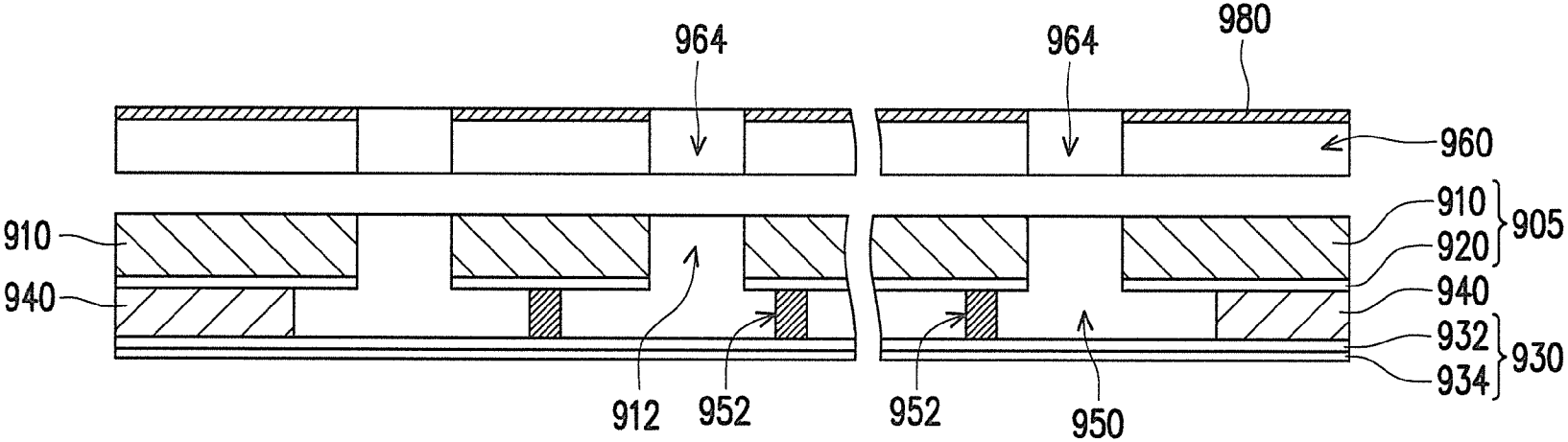
FIG. 9 is a partial cross-section of a speaker panel combination module with a planar light source module placed in front of the speaker panel combination module.

FIG. 9 is a partial cross-section of a speaker panel combination module according to another embodiment. In this embodiment, light is emitted from a planar light source module placed in front of the panel in the transparent speaker.

Speaker panel combination module 900 includes a fixed electrode plate 905, a diaphragm 930, and a frame 940 placed between fixed electrode plate 905 and diaphragm 930. A plurality of sound holes 912 may be formed in fixed electrode plate 905, for enabling the air in the gap between the fixed electrode plate 905 and the diaphragm 930 to pass through sound holes 912 into the ambient environment, such that the vibration of diaphragm 930 pushes the air through the sound holes 912 to make a sound. Fixed electrode plate 905 includes a film layer 910 and an electrode film 920 formed on a surface of film layer 910. Diaphragm 930 includes an electret material 932 and a conductive film 934 formed on a surface of electret material 932. Electrode film 920 is formed on a side of film layer facing diaphragm 930, and conductive film 934 is formed on a surface of diaphragm 930 opposite to the surface facing the electrode plate 905.

A vibration space 950 is formed between fixed electrode plate 905, diaphragm 930, and adjacent spacers 952. Spacers 952 are adhered to fixed electrode plate 905, or formed by stamping fixed electrode plate 905, and have a structure that may be adjusted in height and width according to particular design requirement.

Consistent with the illustrated embodiment, a light source module 960 having a plurality of light emitting units may be provided directly in front of speaker panel combination module 900. Individual light emitting units of light source module may be uniformly and evenly spaced throughout light source module, or may be configured according to design requirements. In this embodiment, sound holes 964 may be formed in light source module 960 to correspond to sound holes 912, to allow sound to be unobstructed as it is emitted from speaker panel combination module 900.

A pattern 980 may be printed on light source module 960. Pattern 980 may be an opaque or semi-transparent pattern, a fluorescent pattern, an obscure glass pattern with diffusion effect, or an engraved pattern. Light illuminating or passing through pattern 980 creates a visual image which is viewable by an observer. Consistent with the disclosed embodiments, pattern 980 may be removable and replaceable such that a user can interchange patterns 980, allowing the user to have many different viewable patterns from which to choose. Consistent with other embodiments, a phosphor powder may be added to pattern 980 or to light source module 960, such that the energy provided by light emitted from light source module 960 remains in the phosphor powder even after light source module 960 is turned off so that speaker panel combination module 900 glows in the dark.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A speaker device, comprising:

a speaker panel combination module comprising:

a diaphragm comprising an electret material having a conductive film formed on a surface of the diaphragm; and a fixed electrode plate having a plurality of openings and a plurality of spacers, the plurality of spacers are placed between the fixed electrode plate and the diaphragm for providing an operation area for the diaphragm to move and generate sound; and a light source module for providing light projected through at least a portion of the speaker panel combination modules.

2. The speaker device according to claim 1, wherein the light source module has a shape of a strip, and the light is projected into an edge of the speaker panel combination module, transmitted through an optical waveguide, and emitted toward at least one direction of directions of sound emitted by the speaker panel combination module.

3. The speaker device according to claim 2, wherein the light source module comprises at least one of a light-emitting diode (LED), a laser, a cold cathode fluorescent lamp (CCFL), or an organic light-emitting diode (OLED).

4. The speaker device according to claim 1, wherein the fixed electrode plate has a diffusion pattern formed over it, the diffusion pattern comprising at least one of a partially opaque pattern, a semi-transparent pattern, a fluorescent pattern, a diffusion glass pattern, and an engraved pattern.

5. The speaker device according to claim 4, wherein the diffusion pattern comprises phosphor powder configured.

6. The speaker device according to claim 1, wherein a transparent thin film having openings is attached to the fixed electrode plate.

7. The speaker device according to claim 6, wherein the transparent thin film has a diffusion pattern comprising at least one of a partially opaque pattern, a semi-transparent pattern, a fluorescent pattern, a diffusion glass pattern, and an engraved pattern.

8. The speaker device according to claim 7, wherein the transparent thin film contains phosphor powder.

9. The speaker device according to claim 1, wherein the speaker panel combination module structure comprises phosphor powder.

10. The speaker device according to claim 1, wherein the spacers are protrusions formed from stamping the fixed electrode plate.

11. The speaker device according to claim 1, further comprising a reflective device coupled to the light source module, the reflective device configured to reflect the light from the light source module and project light through portions of the speaker panel combination module.

12. The speaker device according to claim 11, wherein the reflective device comprises at least one of reflective spots, reflective micro-structures, or convex-concave micro-structures provided on at least a surface of the reflective device.

13. The speaker device according to claim 11, wherein the light plate has a diffusion pattern comprising at least one of a partially opaque pattern, a semi-transparent pattern, a fluorescent pattern, a diffusion glass pattern, and an engraved pattern.

14. The speaker device according to claim 11, wherein the light plate is placed behind the speaker panel combination module, and reflective spots or reflective convex-concave micro-structures are printed on the bottom surface of the light plate so as to reflect the light generated by the light source module.

15. The speaker device according to claim 14, wherein the fixed electrode plate has a diffusion pattern comprising at least one of a partially opaque pattern, a semi-transparent pattern, a fluorescent pattern, a diffusion glass pattern, and an engraved pattern.

16. The speaker device according to claim 15, wherein the diffusion pattern is printed on the fixed electrode plate.

17. The speaker device according to claim 15, wherein the diffusion pattern is attached to the fixed electrode plate.

18. The speaker device according to claim 2, wherein the speaker panel combination module further comprises a frame, and light generated by the light source module is incident on the frame on the periphery of the speaker panel combination module.

19. The speaker device according to claim 2, wherein the conductive film of the diaphragm comprises a reflective film with a reflective effect.

20. The speaker device according to claim 19, wherein the reflective film is a metal reflective film comprising aluminum or silver.

21. The speaker device according to claim 19, wherein the fixed electrode plate comprises a film layer and an electrode film formed on a surface of the film layer, and the fixed electrode plate and the frame are made of a transmissive material.

22. The speaker device according to claim 21, wherein the fixed electrode plate and the frame are made of a transparent polymer material.

23. The speaker device according to claim 22, wherein the polymer material comprises a material selected from among polycarbonate (PC), polyethylene terephthalate (PET), cyclic olefin copolymer (COC), polymethyl methacrylate (PMMA), and any combination thereof.

24. The speaker device according to claim 21, wherein the material of the electrode plate comprises a material selected form among indium tin oxide (ITO), indium zinc oxide (IZO), and any combination thereof.

25. The speaker device according to claim 2, wherein light generated by the light source module is incident on the fixed electrode plate from a periphery of the speaker panel combination module, and the electrode comprises a reflective film with a reflective effect.

26. The speaker device according to claim 25, wherein the reflective film is a metal reflective film of aluminum or silver.

27. The speaker device according to claim 25, wherein the fixed electrode plate is made of a transmissive material.

28. The speaker device according to claim 27, wherein the fixed electrode plate is made of a transparent polymer material.

29. The speaker device according to claim 28, wherein the polymer material comprises a material selected from among PC, PET, COC, PMMA, and any combination thereof.

30. The speaker device according to claim 25, wherein the material of the electrode comprises a material selected from among ITO, IZO, and any combination thereof.

31. A speaker device, comprising:

a speaker panel combination module, comprising:

a diaphragm comprising an electret material and a conductive film is formed on a surface of the diaphragm; and a fixed electrode plate having a plurality of openings and a plurality of spacers, wherein the plurality of spacers are between the fixed electrode plate and the diaphragm for providing an operation area for the diaphragm; and a planar light source module configured to provide light projected from at least a portion of the speaker panel combination module.

32. The speaker device according to claim 31, wherein the planar light source module comprises one of a light-emitting diode (LED), a laser, a cold cathode fluorescent lamp (CCFL), or an organic light-emitting diode (OLED).

33. The speaker device according to claim 31, wherein the planar light source module includes a plurality of openings corresponding to the openings on the fixed electrode plate, and is located in front of the speaker panel combination module, speaker panel combination module, such that the light is emitted in the same direction as the sound.

34. The speaker device according to claim 33, wherein reflective spots or reflective convex-concave micro-structures are printed on a bottom surface of the planar light source module, so as to improve reflection characteristics of the planar light source.

35. The speaker device according to claim 31, wherein the planar light source module is located behind the speaker panel combination module, such that the light is emitted from the speaker panel combination module in the same direction as the sound.

36. The speaker device according to claim 35, wherein the fixed electrode plate is made of a transparent polymer material.

37. The speaker device according to claim 36, wherein the polymer material comprises a material selected from among polycarbonate (PC), polyethylene terephthalate (PET), cyclic olefin copolymer (COC), polymethyl methacrylate (PMMA), and any combination thereof.

38. The speaker device according to claim 35, wherein the material of the electrode comprises a material selected from among indium tin oxide (ITO), indium zinc oxide (IZO), and any combination thereof.

39. The speaker device according to claim 31, wherein the fixed electrode plate is formed with a pattern, and the pattern comprises a transparent thin film with openings.

40. The speaker device according to claim 39, wherein the transparent thin film has a diffusion pattern comprising at least one of a partially opaque pattern, a semi-transparent pattern, a fluorescent pattern, a diffusion glass pattern, and an engraved pattern.

41. The speaker device according to claim 39, wherein a phosphor powder is added to the pattern, such that the energy provided by the light source module remains in the phosphor powder.

42. The speaker device according to claim 39, wherein the pattern is printed on the fixed electrode plate.

43. The speaker device according to claim 39, wherein the pattern is attached to the fixed electrode plate.

44. The speaker device according to claim 31, wherein phosphor powder is added to the speaker panel combination module.

45. The speaker device according to claim 31, wherein the spacers comprise protruding spacers formed by stamping the fixed electrode plate.

46. A speaker device with a transparent speaker panel combination module, wherein the transparent speaker panel combination module comprises:

a diaphragm, made of an electret material, wherein a conductive film is formed on a surface of the diaphragm; and a fixed electrode plate, comprising a plurality of openings and a plurality of spacers, wherein the spacers are placed between the fixed electrode plate and the diaphragm so as to provide an operation area for the diaphragm to move and generate a sound, wherein light from outside the transparent speaker panel is incident through the transparent speaker panel on the transparent speaker panel combination module, so as to enable the transparent speaker panel combination module to make a sound and emit light in the same direction.

47. The speaker device according to claim 46, wherein the fixed electrode plate is made of a transmissive material.

48. The speaker device according to claim 47, wherein the fixed electrode plate is made of a transparent polymer material.

49. The speaker device according to claim 48, wherein the polymer material comprises a material selected from among polycarbonate (PC), polyethylene terephthalate (PET), cyclic olefin copolymer (COC), polymethyl methacrylate (PMMA), and any combination thereof.

50. The speaker device according to claim 49, wherein the material of the electrode comprises a material selected from among indium tin oxide (ITO), indium zinc oxide (IZO), and any combination thereof.

51. The speaker device according to claim 46, wherein a diffusion pattern comprising at least one of a partially opaque pattern, a semi-transparent pattern, a fluorescent pattern, a diffusion glass pattern, and an engraved pattern is printed on a surface of the fixed electrode plate.

52. The speaker device according to claim 51, wherein a phosphor powder is added to the diffusion pattern, such that energy provided by the light source module remains in the phosphor powder.

53. The speaker device according to claim 46, wherein a pattern comprising a transparent thin film with openings is attached to the fixed electrode plate, and the transparent thin film has a diffusion pattern comprising at least one of a partially opaque pattern, a semi-transparent pattern, a fluorescent pattern, a diffusion glass pattern, and an engraved pattern.

54. The speaker device according to claim 53, wherein a phosphor powder is added to the diffusion pattern, such that energy provided by the light source module remains in the phosphor powder.

55. The speaker device according to claim 46, wherein the phosphor powder is added to the transparent speaker panel combination module.

* * * * *